US008994761B2

(12) United States Patent
Eguchi

(10) Patent No.: US 8,994,761 B2
(45) Date of Patent: Mar. 31, 2015

(54) INFORMATION DISPLAY CONTROL APPARATUS, INFORMATION DISPLAY CONTROL METHOD, AND STORAGE MEDIUM STORING INFORMATION DISPLAY CONTROL PROGRAM

(75) Inventor: Katsuya Eguchi, Akishima (JP)

(73) Assignee: Casio Computer Co., Ltd., Tokyo (JP)

( * ) Notice: Subject to any disclaimer, the term of this patent is extended or adjusted under 35 U.S.C. 154(b) by 152 days.

(21) Appl. No.: 13/528,493

(22) Filed: Jun. 20, 2012

(65) Prior Publication Data

US 2012/0327133 A1 Dec. 27, 2012

(30) Foreign Application Priority Data

Jun. 24, 2011 (JP) ..... 2011-140938

(51) Int. Cl.
*G09G 5/10* (2006.01)
*G09G 3/36* (2006.01)

(52) U.S. Cl.
CPC ..... *G09G 3/3611* (2013.01); *G09G 2320/0673* (2013.01); *G09G 2320/068* (2013.01)
USPC ..... 345/690; 345/87; 345/173

(58) Field of Classification Search
CPC ..... G09G 3/3611; G09G 2320/0673; G09G 2320/06; G09G 2320/068; G09G 2320/00
USPC ..... 345/156, 173, 174, 178, 690, 204
See application file for complete search history.

(56) References Cited

U.S. PATENT DOCUMENTS

| | | | | |
|---|---|---|---|---|
| 2001/0048413 | A1* | 12/2001 | Tabata | 345/87 |
| 2005/0117186 | A1* | 6/2005 | Li et al. | 359/15 |
| 2006/0087521 | A1* | 4/2006 | Chu et al. | 345/690 |
| 2007/0052735 | A1* | 3/2007 | Chou | 345/690 |
| 2007/0120876 | A1 | 5/2007 | Nishida et al. | |
| 2008/0309627 | A1* | 12/2008 | Hotelling et al. | 345/173 |
| 2010/0002015 | A1* | 1/2010 | Handa | 345/650 |
| 2010/0060667 | A1* | 3/2010 | Chen et al. | 345/690 |
| 2010/0182265 | A1* | 7/2010 | Kim et al. | 345/173 |
| 2013/0307881 | A1* | 11/2013 | Hsieh | 345/690 |

FOREIGN PATENT DOCUMENTS

| | | | |
|---|---|---|---|
| CN | 101425262 | A | 6/2009 |
| CN | 101305407 | B | 11/2010 |
| JP | 2003-158573 | A | 5/2003 |

(Continued)

OTHER PUBLICATIONS

Chinese Office Action dated Jan. 28, 2014 (and English translation thereof) in counterpart Japanese Application No. 201210288634.2.

*Primary Examiner* — Vijay Shankar
*Assistant Examiner* — Abhishek Sarma
(74) *Attorney, Agent, or Firm* — Holtz, Holtz, Goodman & Chick PC

(57) ABSTRACT

There is provided an information display apparatus. The information display apparatus includes a plurality of display units separately arranged in a foldable housing, a detection unit configured to detect posture angles of the plurality of display units, a gamma storage unit configured to store gamma correction values for the plurality of display units according to a relationship between the posture angles, and a display control unit configured to perform gamma correction on the plurality of display units by referring to the gamma storage unit based on the posture angles of the plurality of display units which are detected by the detection unit.

9 Claims, 12 Drawing Sheets

(56) References Cited

FOREIGN PATENT DOCUMENTS

| | | | |
|---|---|---|---|
| JP | 2006-267456 | A | 10/2006 |
| JP | 2006-276692 | A | 10/2006 |
| JP | 2007-271974 | A | 10/2007 |
| JP | 2010-044179 | A | 2/2010 |

* cited by examiner

FIG.6A

22B (BEING USED IN STATIONARY POSITION)

| MAIN DISPLAY ANGLE θ' (= 180° - θ) | MAIN DISPLAY GAMMA CORRECTION VALUE | AUXILIARY DISPLAY GAMMA CORRECTION VALUE |
|---|---|---|
| 0° | α [0] | α' [0] |
| 1° | α [1] | α' [1] |
| 2° | α [2] | α' [2] |
| 3° | α [3] | α' [3] |
| 4° | α [4] | α' [4] |
| ⋮ | ⋮ | ⋮ |
| 86° | α [86] | α' [86] |
| 87° | α [87] | α' [87] |
| 88° | α [88] | α' [88] |
| 89° | α [89] | α' [89] |
| 90° | α [90] | α' [90] |

FIG.6B

22B (BEING USED IN PORTRAIT POSITION)

| ANGLE θ BETWEEN TWO DISPLAYS | MAIN DISPLAY GAMMA CORRECTION VALUE | AUXILIARY DISPLAY GAMMA CORRECTION VALUE |
|---|---|---|
| 90° | β [90] | β' [90] |
| 91° | β [91] | β' [91] |
| 92° | β [92] | β' [92] |
| 93° | β [93] | β' [93] |
| 94° | β [94] | β' [94] |
| ⋮ | ⋮ | ⋮ |
| 176° | β [176] | β' [176] |
| 177° | β [177] | β' [177] |
| 178° | β [178] | β' [178] |
| 179° | β [179] | β' [179] |
| 180° | β [180] | β' [180] |

FIG.6C

22B (BEING USED IN LANDSCAPE POSITION)

| ANGLE θ BETWEEN TWO DISPLAYS | MAIN DISPLAY GAMMA CORRECTION VALUE | AUXILIARY DISPLAY GAMMA CORRECTION VALUE |
|---|---|---|
| 90° | δ [90] | δ' [90] |
| 91° | δ [91] | δ' [91] |
| 92° | δ [92] | δ' [92] |
| 93° | δ [93] | δ' [93] |
| 94° | δ [94] | δ' [94] |
| ⋮ | ⋮ | ⋮ |
| 176° | δ [176] | δ' [176] |
| 177° | δ [177] | δ' [177] |
| 178° | δ [178] | δ' [178] |
| 179° | δ [179] | δ' [179] |
| 180° | δ [180] | δ' [180] |

FIG.11A

| MAIN DISPLAY LINE-OF-SIGHT ANGLE θm | MAIN DISPLAY GAMMA CORRECTION VALUE |
|---|---|
| 0° | αm [0] |
| 1° | αm [1] |
| 2° | αm [2] |
| 3° | αm [3] |
| 4° | αm [4] |
| ⋮ | ⋮ |
| 90° | αm [90] |
| ⋮ | ⋮ |
| 100° | αm [100] |
| 101° | αm [101] |
| 102° | αm [102] |
| 103° | αm [103] |
| ⋮ | ⋮ |
| 147° | αm [147] |
| 148° | αm [148] |
| 149° | αm [149] |
| 150° | αm [150] |

FIG.11B

| AUXILIARY DISPLAY LINE-OF-SIGHT ANGLE θs | AUXILIARY DISPLAY GAMMA CORRECTION VALUE |
|---|---|
| 0° | αs [0] |
| 1° | αs [1] |
| 2° | αs [2] |
| 3° | αs [3] |
| 4° | αs [4] |
| ⋮ | ⋮ |
| 90° | αs [90] |
| ⋮ | ⋮ |
| 100° | αs [100] |
| 101° | αs [101] |
| 102° | αs [102] |
| 103° | αs [103] |
| ⋮ | ⋮ |
| 147° | αs [147] |
| 148° | αs [148] |
| 149° | αs [149] |
| 150° | αs [150] |

FIG.11C

| ANGLE θ BETWEEN TWO DISPLAYS | MAIN DISPLAY LINE-OF-SIGHT ANGLE θm | AUXILIARY DISPLAY LINE-OF-SIGHT ANGLE θs |
|---|---|---|
| 90° | θm [90] | θs [90] |
| 91° | θm [91] | θs [91] |
| 92° | θm [92] | θs [92] |
| 93° | θm [93] | θs [93] |
| 94° | θm [94] | θs [94] |
| ⋮ | ⋮ | ⋮ |
| 176° | θm [176] | θs [176] |
| 177° | θm [177] | θs [177] |
| 178° | θm [178] | θs [178] |
| 179° | θm [179] | θs [179] |
| 180° | θm [180] | θs [180] |

INFORMATION DISPLAY CONTROL APPARATUS, INFORMATION DISPLAY CONTROL METHOD, AND STORAGE MEDIUM STORING INFORMATION DISPLAY CONTROL PROGRAM

CROSS-REFERENCE TO RELATED APPLICATIONS

This application is based upon and claims the benefit of priority from prior Japanese Patent Application No. 2011-140938, filed Jun. 24, 2011, the entire contents of which are incorporated herein by reference.

BACKGROUND OF THE INVENTION

1. Field of the Invention

The present invention relates to an information display apparatus, information display control method, and a storage medium storing program, suitable for a foldable electronic organizer, electronic book, or the like.

2. Description of the Related Art

Studies have been conducted on techniques of improving display quality by adjusting the viewing angle of a liquid crystal in one display panel by detecting its tilt angle.

The conventional technique is effective only for one display panel. In contrast to this, there are many types of foldable apparatuses using two display panels, such as currently available electronic dictionary apparatuses, cellular phone terminals, and portable video game machines. When using an apparatus having two display panels, the line of sight of the user differs with respect to these display panels. For this reason, even if one display panel is properly adjusted, the other display panel is not properly adjusted because of the difference in line-of-sight, angle between the two display panels, resulting in deterioration in display quality. That is, the technique disclosed in above patent literature cannot be applied to such an apparatus.

Under the circumstance, it is desired to provide an information display apparatus with a plurality of display panels, capable of ensuring optimal visual fields regardless of the angles at which the user sees the respective display panels and a program.

BRIEF SUMMARY OF THE INVENTION

According to one aspect of the present invention, there is provided an information display apparatus comprising: a plurality of display units separately arranged in a foldable housing; a detection unit configured to detect posture angles of the plurality of display units; a gamma storage unit configured to store gamma correction values for the plurality of display units according to a relationship between the posture angles; and a display control unit configured to perform gamma correction on the plurality of display units by referring to the gamma storage unit based on the posture angles of the plurality of display units which are detected by the detection unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 6A is a view exemplifying the contents of a gamma correction value table stored in a program memory according to the first embodiment;

FIG. 6B is a view exemplifying the contents of a gamma correction value table stored in the program memory according to the first embodiment;

FIG. 6C is a view exemplifying the contents of a gamma correction value table stored in the program memory according to the first embodiment;

FIG. 11A is a view exemplifying the contents of a gamma correction value table stored in a program memory according to the second embodiment;

FIG. 11B is a view exemplifying the contents of a gamma correction value table stored in the program memory according to the second embodiment;

FIG. 11C is a view exemplifying the contents of a gamma correction value table stored in the program memory according to the second embodiment;

DETAILED DESCRIPTION OF THE INVENTION

First Embodiment

The first embodiment in which the present invention is applied to an electronic dictionary apparatus will be described with reference to the views of the accompanying drawing.

Figure 1:
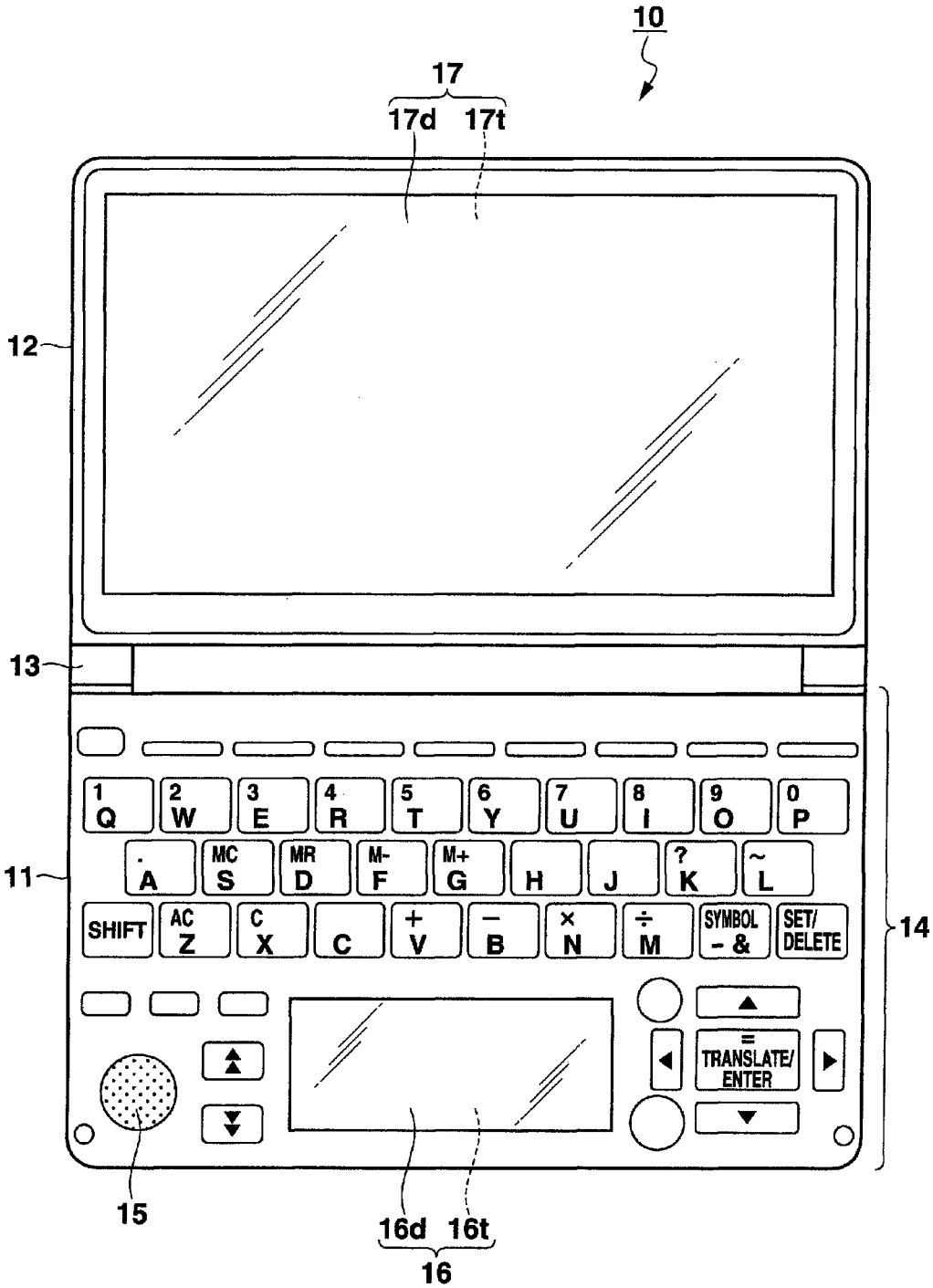
FIG. 1 is a front view showing the outer arrangement of an electronic dictionary apparatus according to the first embodiment of the present invention.

FIG. 1 is a front view showing the outer arrangement of an electronic dictionary apparatus 10 according to the first embodiment.

The electronic dictionary apparatus 10 is configured as a portable apparatus dedicated to an electronic dictionary (to be described below) or a FDA (Personal Digital Assistants), personal computer, cellular phone terminal, electronic book, portable video game machine, or the like which has a dictionary function.

The electronic dictionary apparatus 10 includes a foldable case configured such that a main body case 11 and a lid case 12 can open and close relative to each other through a hinge portion 13. FIG. 1 shows the open state. The surface of the main body case 11 in the open state of this foldable case includes a key input unit (keyboard) 14 including character input keys, a dictionary designation key and the like, a [translate/Enter] key, a [return/list] key, cursor (↑, ↓, ←, →) keys, a [jump] key, and a loudspeaker 15 and a handwriting input unit (auxiliary screen) 16.

The handwriting input unit (auxiliary screen) 16 has an integrated structure of a display unit and a touch position detection unit which detects the position touched by the user with a stylus pen, finger, or the like. A transparent touchpanel 16*t* is stacked on a 256×64 dot color liquid crystal display screen 16*d* on the middle front side of the key input unit 14.

The area of the handwriting input unit (auxiliary screen) 16 is switched between a handwritten character (kanji) input area for inputting handwritten characters, an icon input area for various kinds of functions, and the like, as needed.

The trace of handwriting in a state in which the handwriting input unit (auxiliary screen) 16 is switched to the handwritten character input area is echoed back and displayed on the color liquid crystal display screen 16*d*.

A 480×320 dot touchpanel color display unit (main screen) 17 with a backlight is provided on almost the entire surface of the lid case 12. Like the handwriting input unit (auxiliary screen) 16, the touchpanel color display unit (main screen) 17 also has an integrated structure of a display apparatus and a touch position detection apparatus which detects the position touched by the user with a stylus pen, finger, or the like. A transparent touchpanel 17*t* is stacked on a color liquid crystal display screen 17*d*.

Figure 2:
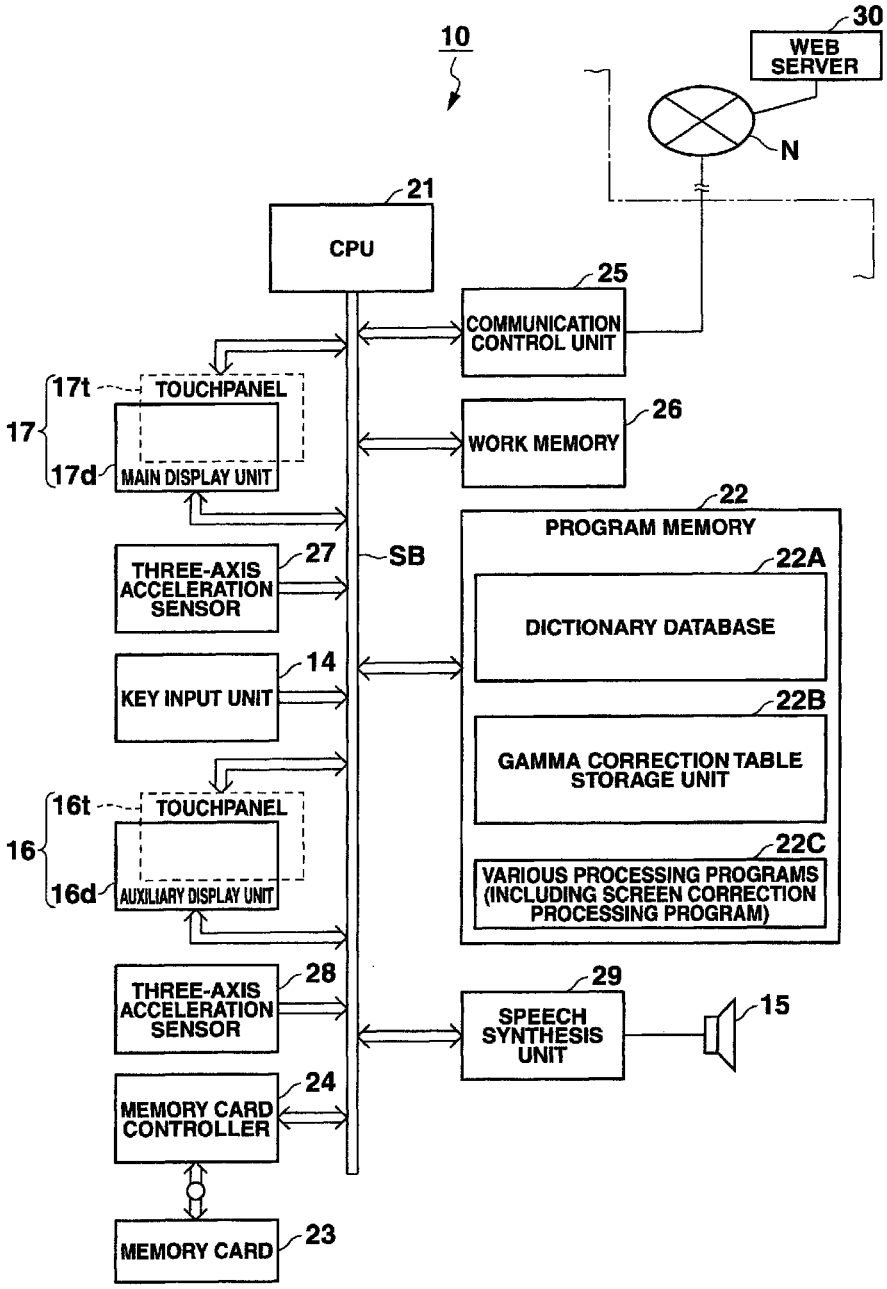
FIG. 2 is a block diagram showing the functional arrangement of an electronic circuit according to the first embodiment.

FIG. 2 is a block diagram showing the arrangements of electronic circuits provided in the main body case 11 and lid case 12 of the electronic dictionary apparatus 10 described above.

The electronic dictionary apparatus 10 reads programs recorded on various types of storage media or transmitted programs. A control computer controls the operation of the electronic dictionary apparatus 10 in accordance with the read programs. The electronic circuit of the electronic dictionary apparatus 10 includes a CPU 21.

The CPU 21 is connected to a program memory (flash memory) 22 via a system bus SB. The CPU 21 controls the operation of each circuit portion by using a work memory 26 formed from an SRAM as a main memory in accordance with the apparatus control program stored in the program memory 22 in advance, the apparatus control program stored from a memory card 23 in the program memory 22 via a memory card controller 24, or the apparatus control program stored in the program memory 22 from a Web server (in this case, a program server) 30 on Internet N via a communication control unit 25.

The apparatus control program stored in the program memory 22 is activated in accordance with an input signal from the key input unit 14 according to user operation, a communication signal with each Web server 30 on the Internet N, which is connected via the communication control unit 25, or a connection communication signal with the memory card 23 connected via the memory card controller 24.

The components connected to the CPU 21 via the system bus SB include the color liquid crystal display screen 16*d*, the transparent touchpanel 16*t*, the color liquid crystal display screen 17*d*, the transparent touchpanel 17*t*, a three-axis acceleration sensor 27, three-axis acceleration sensor 28, and a speech synthesis unit 29, in addition to the program memory 22, the memory card controller 24, the communication control unit 25, the work memory 26, and the key input unit 14 connected via the system bus SB.

The apparatus control programs stored in the program memory 22 include a dictionary database 22A, a gamma correction table storage unit 22B, and various types of processing programs 22C.

The dictionary database 22A includes various types of dictionary contents and dictionary name information for displaying the name of each dictionary content on the touchpanel color display unit 17.

The gamma correction table storage unit 22B stores gamma correction values for performing display operation on the color liquid crystal display screen 16*d* of the main body case 11 and the color liquid crystal display screen 17*d* of the lid case 12 in accordance with the posture angles of both the main body case 11 and the lid case 12, as will be described later.

The various types of processing programs 22C include a screen correction processing program for performing gamma correction of images to be displayed on the color liquid crystal display screen 16*d* and the color liquid crystal display screen 17*d* at the posture angles of the main body case 11 and lid case 12, and are constituted by programs for controlling the overall operation in the electronic dictionary apparatus 10.

In the specification, the processing for "gamma correction" indicates correcting the drive voltages for the color liquid crystal display screen 16*d* and the color liquid crystal display screen 17*d* using respectively gamma correction values that correspond to the posture angle of the main body case 11 and the posture angle of the lid case 12.

The three-axis acceleration sensor 27 is provided on the lid case 12 to detect accelerations in the three axial directions perpendicular to each other and output them to the CPU 21. The CPU 21 can recognize the posture of the lid case 12 from the direction of gravitational acceleration based on the outputs from the three-axis acceleration sensor 27.

Likewise, the three-axis acceleration sensor 28 is provided on the main body case 11 to detect accelerations in the three axial directions perpendicular to each other and output them to the CPU 21. The CPU 21 can recognize the posture of the main body case 11 from the direction of gravitational acceleration based on the outputs from the three-axis acceleration sensor 28.

In this manner, the CPU 21 can comprehend how the user is currently using the electronic dictionary apparatus 10, based on the posture angles of both the main body case 11 and the lid case 12.

The speech synthesis unit 29 generates an analog speech signal based on text information supplied via the system bus SB and drives the loudspeaker 15 in accordance with the generated speech signal, thereby audibly outputting the corresponding information.

Referring to FIG. 2 described above, the three-axis acceleration sensor 28 and the three-axis acceleration sensor 27 are provided on the main body case 11 side and the lid case 12 side, respectively, to make the CPU 21 comprehend, based on the detection outputs from the sensors, how the electronic dictionary apparatus 10 is used, from the posture angles of both the main body case 11 and the lid case 12.

There is available another arrangement which detects the posture angle of one case and the angle of the hinge portion 13 to estimate the posture angle of the other case, thereby allowing to comprehend how the electronic dictionary apparatus 10 is used.

Figure 3:
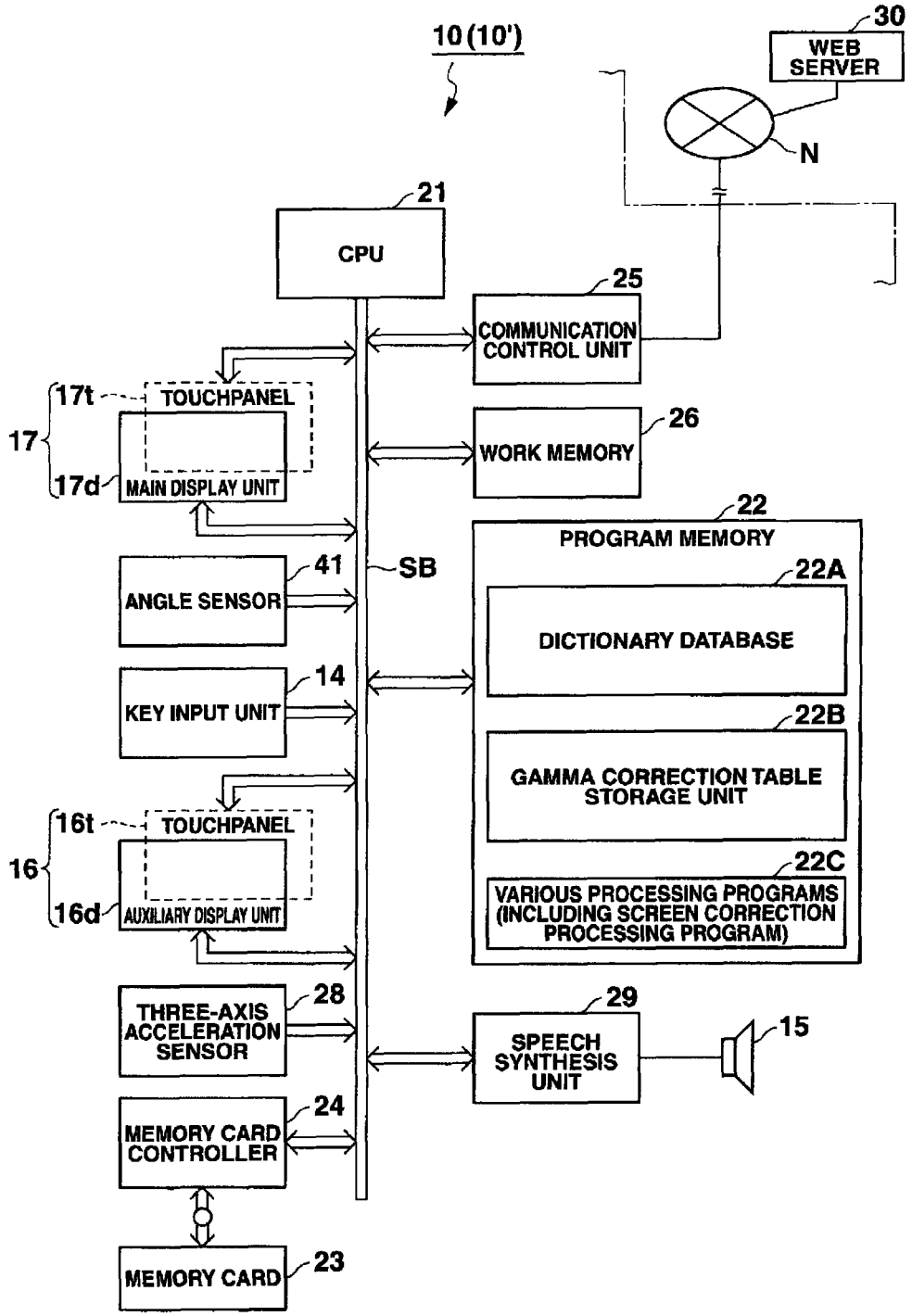
FIG. 3 is a block diagram showing another functional arrangement of the electronic circuit according to the first embodiment.

FIG. 3 is a block diagram showing another arrangement of the electronic circuits provided in the main body case 11 and lid case 12 of the electronic dictionary apparatus 10 described above. This arrangement includes an angle sensor 41 which detects an open angle at the hinge portion 13 in place of the three-axis acceleration sensor 27 in FIG. 2.

The angle sensor 41 is formed from a strain gauge sensor, magnetic sensor, or optical sensor. This sensor detects an open angle at the hinge portion 13 and outputs the detection result to the CPU 21.

The arrangement shown in FIG. 3 is basically the same as that shown in FIG. 2 except that the angle sensor 41 is provided in placed of the three-axis acceleration sensor 27 in FIG. 2. Therefore, the same reference numerals denote the same parts, and a description of them will be omitted.

The operation of the above embodiment will be described next.

Figure 4A:
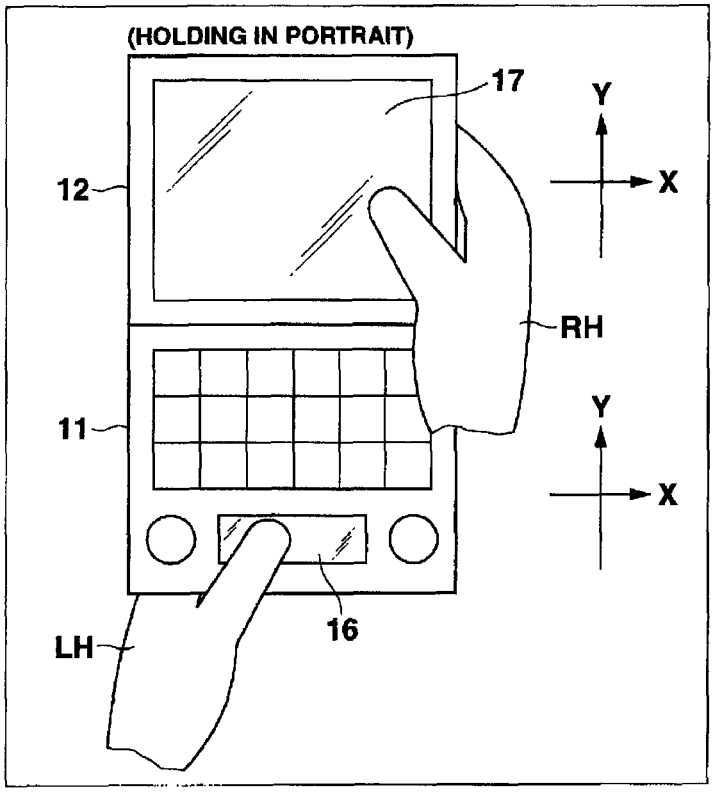
FIG. 4A is a view showing two basic forms when the user uses an electronic dictionary apparatus according to the first embodiment while holding it.
Figure 4B:
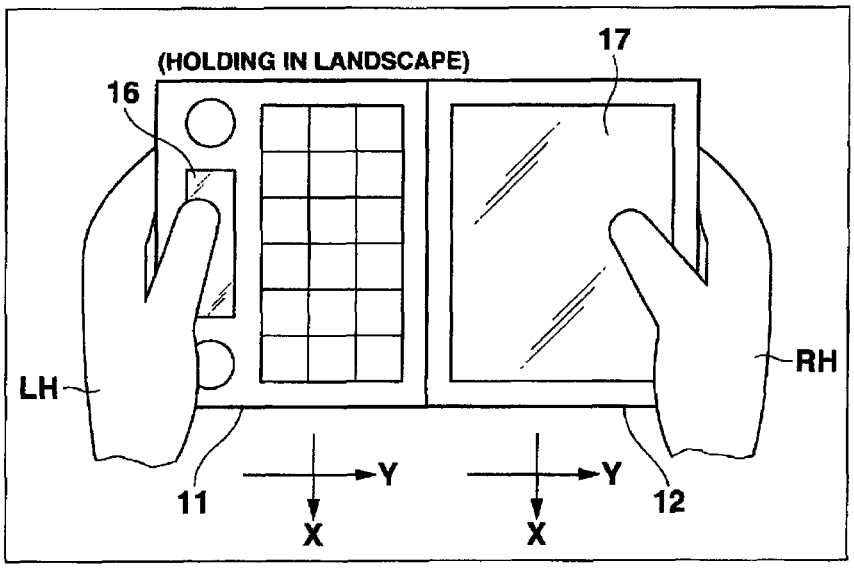
FIG. 4B is a view showing the two basic forms when the user uses the electronic dictionary apparatus according to the first embodiment while holding it.

Note that in this embodiment, the basic usage patterns of the electronic dictionary apparatus 10 are as follows: using the electronic dictionary apparatus 10 while placing it on a desk or the like; holding the electronic dictionary apparatus 10 in the portrait position with the main body case 11 and the lid case 12 being open wide as shown in FIG. 4A, that is, the way of holding the electronic dictionary apparatus 10 which is called "holding in portrait" hereinafter; and holding the electronic dictionary apparatus 10 in the landscape position with the main body case 11 and the lid case 12 being open wide as shown in FIG. 4B, that is, the way of holding the electronic dictionary apparatus 10 which is called "holding in landscape" hereinafter.

FIGS. 4A and 4B each exemplify the state in which the user holds the electronic dictionary apparatus 10 with his/her both hands, that is, a left hand LH and a right hand RH. However, the way of holding the electronic dictionary apparatus 10 is not specifically limited.

In "holding in portrait" shown in FIG. 4A, the CPU 21 can comprehend the posture angles of the main body case 11 and lid case 12 from detection outputs from the three-axis acceleration sensors 28 and 27, with the horizontal direction along the flat casing surface of each of the main body case 11 and lid case 12 being the X-axis direction, the vertical direction of the casing surface being the Y-axis direction, and the direction perpendicular to the casing surface being the Z-axis direction.

In "holding in landscape" shown in FIG. 4B, the CPU 21 can comprehend the posture angles of the main body case 11 and lid case 12 from detection outputs from the three-axis acceleration sensors 28 and 27, with the horizontal direction along the flat casing surface of each of the main body case 11 and lid case 12 being the Y-axis direction, the vertical direction of the casing surface being the X-axis direction, and the direction perpendicular to the casing surface being the Z-axis direction.

The following is a description of operation when using the electronic dictionary apparatus 10 while placing it on a desk or the like, in "holding in portrait" shown in FIG. 4A, and in "holding in landscape" shown in FIG. 4B.

Figure 5:
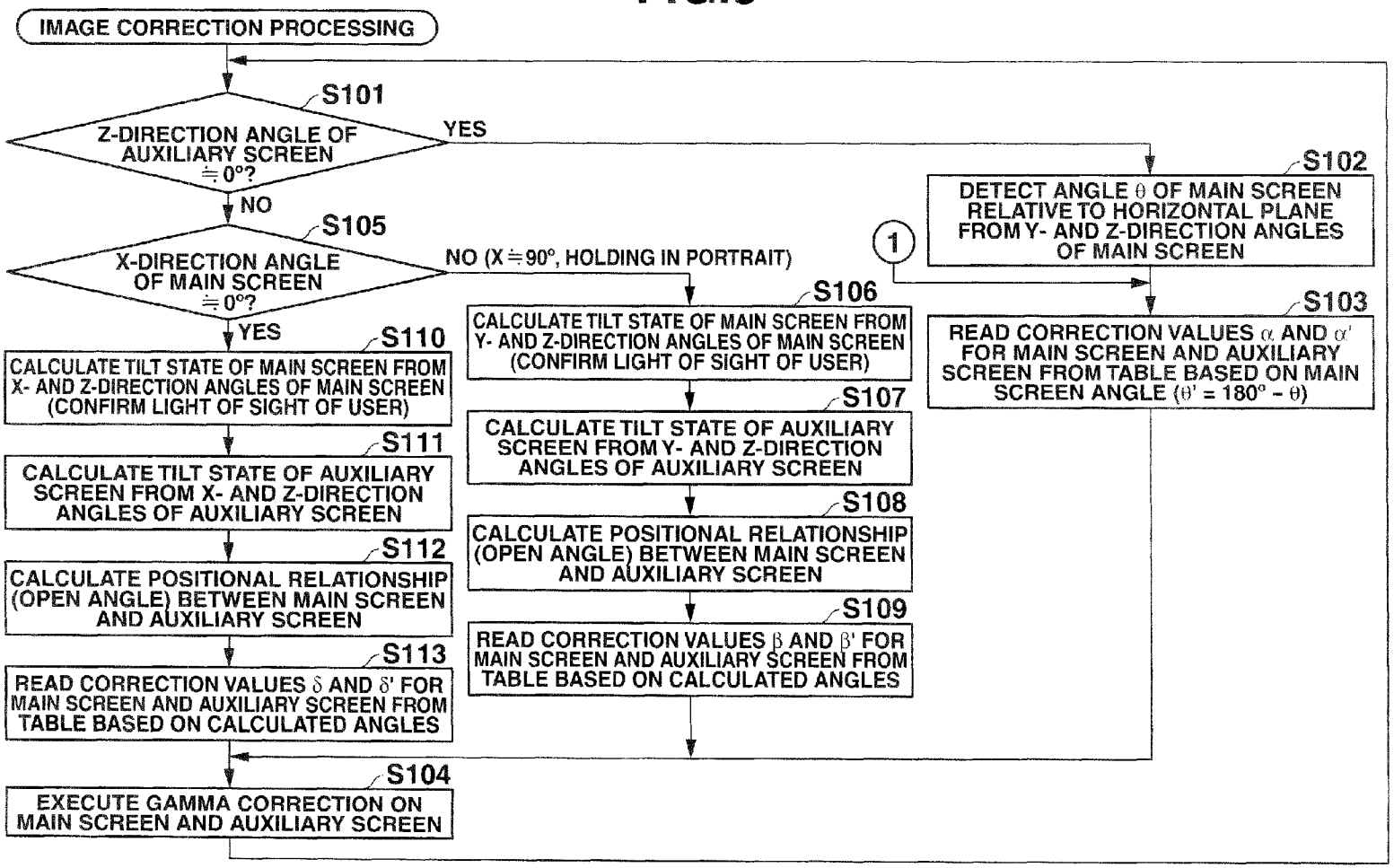
FIG. 5 is a flowchart showing the contents of display correction processing in accordance with the angles of both the main and auxiliary screens according to the first embodiment.

FIG. 5 is a flowchart showing processing associated with display control on the color liquid crystal display screen 17*d* as the main screen and the color liquid crystal display screen 16*d* as the auxiliary screen, which is performed by the CPU 21 in the electronic dictionary apparatus 10 described above.

First of all, the CPU 21 determines whether the main body case 11 of the electronic dictionary apparatus 10 is placed on a horizontal place on, for example, a desk, by determining whether a detection output from the three-axis acceleration sensor 28 provided on the main body case 11 side, on which the handwriting input unit (auxiliary screen) 16 exists, in the Z-axis direction is almost equal to the gravitational acceleration component, and its displacement angle is almost zero (step S101).

In this case, upon determining that the detection output from the three-axis acceleration sensor 28 in the Z-axis direction is almost equal to the gravitational acceleration component and the main body case 11 of the electronic dictionary apparatus 10 is placed on a flat place, the CPU 21 detects an angle θ of the touchpanel color display unit (main screen) 17 relative to the handwriting input unit (auxiliary screen) 16 from detection outputs from the three-axis acceleration sensor 27 provided on the lid case 12 side, on which the touchpanel color display unit (main screen) 17 exists, in the Y-axis and Z-axis directions (step 102).

The CPU 21 then calculates an angle θ' of the touchpanel color display unit (main screen) 17 from the detected angle θ according to (180°−θ), and reads gamma correction values for the touchpanel color display unit (main screen) 17 and the handwriting input unit (auxiliary screen) 16 from the gamma correction table storage unit 22B based on the calculated angle θ' of the handwriting input unit (auxiliary screen) 16 (step S103).

FIG. 6A exemplifies a gamma correction value table for the main screen and the auxiliary screen which is used when the user uses the electronic dictionary apparatus 10 in the stationary position and is stored in the gamma correction table storage unit 22B of the program memory 22. As shown in FIG. 6A, this table stores gamma correction values α and α' for the main screen and auxiliary screen in increments of 1° as the display angle θ' of the main screen changes from 0 to 90°.

The CPU 21 executes gamma correction in display driving on the color liquid crystal display screen 17*d* and the color liquid crystal display screen 16*d* based on the gamma correction values α and α' read in this manner (step S104). The process then returns to the processing starting from step S101.

Figure 7A:
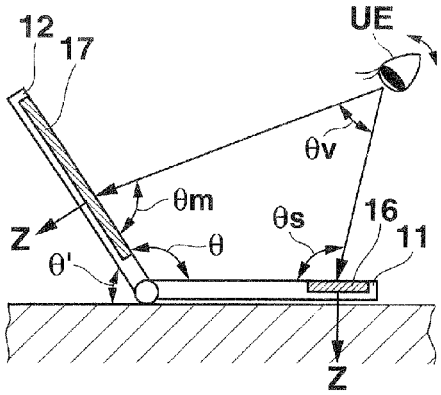
FIG. 7A is a view showing the positional relationship between an eye of the user and each screen at the time of use of an electronic dictionary apparatus according to the first embodiment placed in the stationary position.
Figure 7B:
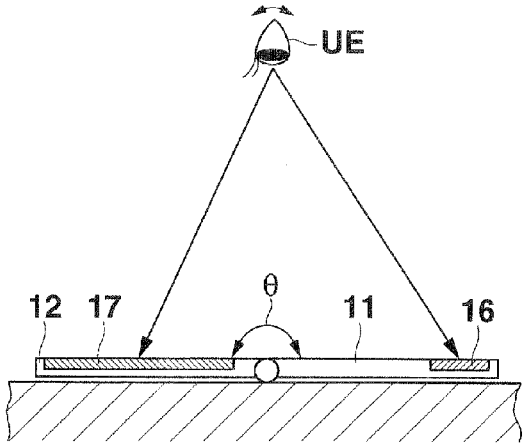
FIG. 7B is a view showing the positional relationship between the eye of the user and each screen at the time of use of the electronic dictionary apparatus according to the first embodiment held in the stationary position.

FIGS. 7A and 7B are views each showing a case in which the positional relationship between an eye UE of the user and each screen is viewed laterally when the user uses the electronic dictionary apparatus 10 in the stationary position.

FIG. 7A shows a state in which the lid case 12 on which the main screen exists is slightly raised. The open angle θ of the lid case 12 relative to the main body case 11 is about 135°, and the display angle θ' of the main screen is about 45°. Assume that the position of the eye UE of the user is set in advance to 20 cm to the front side of the main body case 11 and 40 cm above it.

When viewing the main screen 17*d* from the eye UE of the user, the downward viewing angle required for the main screen 17*d* is (90°−θm), where θm is the interior angle defined by the line of sight of the eye and the main screen 17*d*.

When viewing the auxiliary screen 16*d* from the eye UE of the user, the downward viewing angle required for the auxiliary screen 16*d* is (θs−90°, where θs is the interior angle defined by the line of sight of the eye and the auxiliary screen 16*d*.

The CPU 21 reads the gamma correction values α and α' from the gamma correction table storage unit 22B stored in advance in accordance with the viewing angles of the main screen and auxiliary screen assumed in the above manner, and executes gamma correction in display driving on the main screen 17*d* and the auxiliary screen 16*d* based on the read gamma correction values α and α', thereby reliably positioning the user within the viewing angle.

FIG. 7B shows a state in which the lid case 12 side on which the main screen exists is laid down like the main body case 11 side on which the auxiliary screen exists. The open angle θ of the lid case 12 relative to the main body case 11 is 180°, and the display angle θ' of the main screen is 0°.

The CPU 21 reads the gamma correction values α and α' from the gamma correction table storage unit 22B and executes gamma correction in display driving on the main screen 17*d* and the auxiliary screen 16*d* based on the read gamma correction values α and α', thereby adjusting the two screens so as to reliably position the user within the viewing angle.

Upon determining in step S101 in FIG. 5 that the detection output from the three-axis acceleration sensor 28 in the Z-axis direction differs from the gravitational acceleration component and the main body case 11 of the electronic dictionary apparatus 10 is not horizontal, the CPU 21 determines that the user is holding the electronic dictionary apparatus 10 in the portrait position or the landscape position. The CPU 21 then determines whether the user is using the electronic dictionary apparatus 10 while holding the main body case 11 in the landscape position shown in FIG. 4B, by determining whether the detection output from the three-axis acceleration sensor 27 on the lid case 12 side, on which the main screen 17*d* exists, in the X-axis direction is almost equal to the gravitational acceleration component and the displacement angle is almost zero (step S105).

In this case, upon determining that the detection output from the three-axis acceleration sensor 27 in the X-axis direction differs from the gravitational acceleration component and the displacement angle is almost equal to 90°, the CPU 21 determines that the user is holding the electronic dictionary apparatus 10 in the portrait position shown in FIG. 4A instead of the landscape position. The CPU 21 then calculates the tilt state of the touchpanel color display unit (main screen) 17 from the detection outputs from the three-axis acceleration sensor 27 provided on the lid case 12 side, on which the touchpanel color display unit (main screen) 17 exists, in the Y-axis and Z-axis directions (step S106).

The CPU 21 calculates the tilt state of the handwriting input unit (auxiliary screen) 16 from the detection outputs from the three-axis acceleration sensor 28 provided on the main body case 11 side, on which the handwriting input unit (auxiliary screen) 16 exists, in the Y-axis and Z-axis directions (step S107).

Based on the tilts of the touchpanel color display unit (main screen) 17 and handwriting input unit (auxiliary screen) 16 calculated by the processing in steps S106 and S107, the CPU 21 calculates the open angle θ of the lid case 12 relative to the main body case 11 from these positional relationships (step S106).

The CPU 21 then reads gamma correction values for the touchpanel color display unit (main screen) 17 and the handwriting input unit (auxiliary screen) 16 from the gamma correction table storage unit 22B based on the calculated angle θ (step S109).

FIG. 6B exemplifies a gamma correction value table for the main screen and the auxiliary screen which is used when the user uses the electronic dictionary apparatus 10 while holding it in the portrait position and is stored in the gamma correction table storage unit 22B of the program memory 22. As shown in FIG. 6B, this table stores gamma correction values β and β' for the main screen and auxiliary screen in increments of 1° as the display angle θ' between the two display screens, namely the main screen and the auxiliary screen, changes from 90° to 180°.

The CPU 21 executes gamma correction in display driving on the color liquid crystal display screen 17*d* and the color liquid crystal display screen 16*d* based on the gamma correction values β and β' read in this manner (step S104). The process then returns to the processing starting from step S101.

Figure 8A:
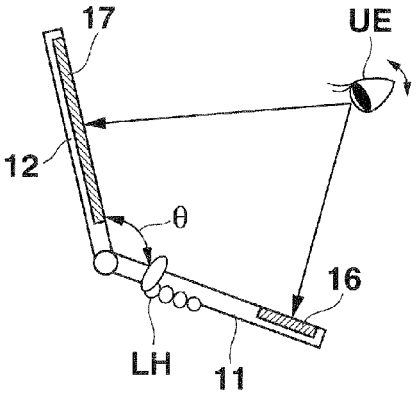
FIG. 8A is a view showing the positional relationship between the eye of the user and each screen at the time of use of the electronic dictionary apparatus according to the first embodiment held in the portrait position.
Figure 8B:
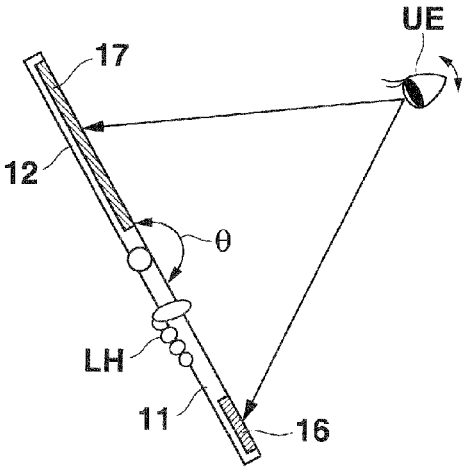
FIG. 8B is a view showing the positional relationship between the eye of the user and each screen at the time of use of the electronic dictionary apparatus according to the first embodiment held in the portrait position.

FIGS. 8A and 8B are views each showing a case in which the positional relationship between the eye UE of the user and each screen is viewed laterally when the user uses the electronic dictionary apparatus 10 while holding it in the portrait position.

FIG. 8A shows a state in which the lid case 12 side (θ) on which the main screen exists is open at about 135° relative to the main body case 11 on which the auxiliary screen exists.

FIG. 8B shows a case in which the open angle θ of the lid case 12 relative to the main body case 11 is set to 180° so as to make the lid case 12 side, on which the main screen exists, flush with the main body case 11 when the user uses the electronic dictionary apparatus 10 while holding it in the portrait position.

The CPU 21 reads the gamma correction values β and β' from the gamma correction table storage unit 22B described above, and executes gamma correction in display driving on the main screen 17*d* and the auxiliary screen 16*d* based on the read gamma correction values β and β', thereby adjusting the display tones of the two screens so as to reliably position the eye UP of the user within the viewing angle.

In addition, upon determining in step S105 that the detection output from the three-axis acceleration sensor 27 on the lid case 12 side, on which the main screen 17*d* exists, is almost equal to the gravitational acceleration component, and the displacement angle is almost zero, the CPU 21 determines that the user is holding the electronic dictionary apparatus 10 in the landscape position shown in FIG. 4B. The CPU 21 then calculates the tilt state of the touchpanel color display unit (main screen) 17 from the detection outputs from the three-axis acceleration sensor 27 provided on the lid case 12 side, on which the touchpanel color display unit (main screen) 17 exists, in the X-axis and Z-axis directions (step S110).

The CPU 21 calculates the tilt state of the handwriting input unit (auxiliary screen) 16 from the detection outputs from the three-axis acceleration sensor 28 provided on the main body case 11 side, on which the handwriting input unit (auxiliary screen) 16 exists, in the X-axis and Z-axis directions (step S111).

Based on the tilts of the touchpanel color display unit (main screen) 17 and handwriting input unit (auxiliary screen) 16 calculated by the processing in steps S110 and S111, the CPU 21 calculates the open angle θ of the lid case 12 relative to the main body case 11 from these positional relationships (step S112).

The CPU 21 then reads gamma correction values for the touchpanel color display unit (main screen) 17 and the handwriting input unit (auxiliary screen) 16 from the gamma correction table storage unit 22B based on the calculated angle θ (step S113).

FIG. 6C exemplifies a gamma correction value table for the main screen and the auxiliary screen which is used when the user uses the electronic dictionary apparatus 10 while holding it in the landscape position and is stored in the gamma correction table storage unit 22B of the program memory 22. As shown in FIG. 6C, this table stores gamma correction values δ and δ' for the main screen and auxiliary screen in increments of 1° as the display angle θ' between the two display screens, namely the main screen and the auxiliary screen, changes from 90 to 180°.

The CPU 21 executes gamma correction in display driving on the color liquid crystal display screen 17*d* and the color liquid crystal display screen 16*d* based on the gamma correction values δ and δ' read in this manner (step S104). The process then returns to the processing starting from step S101.

Figure 9A:
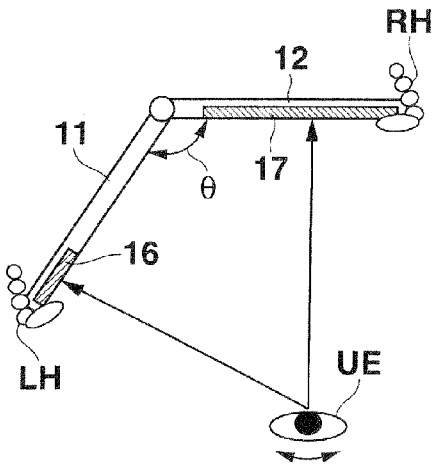
FIG. 9A is a view showing the positional relationship between the eye of the user and each screen at the time of use of the electronic dictionary apparatus according to the first embodiment held in the landscape position.
Figure 9B:
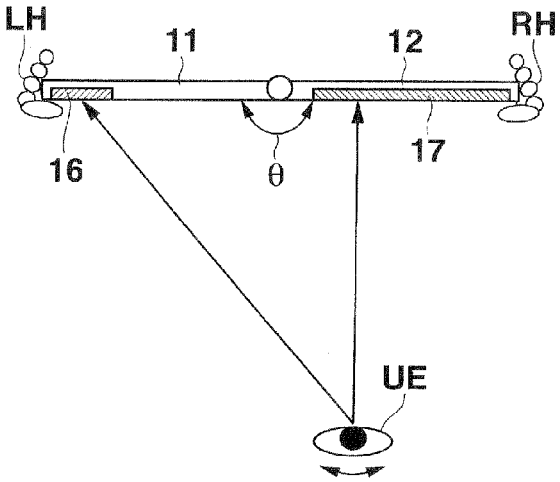
FIG. 9B is a view showing the positional relationship between the eye of the user and each screen at the time of use of the electronic dictionary apparatus according to the first embodiment held in the landscape position.

FIGS. 9A and 9B are views each showing a case in which the positional relationship between the eye UE of the user and each screen is viewed from above when the user uses the electronic dictionary apparatus 10 while holding it in the landscape position.

FIG. 9A shows a state in which the lid case 12 side (θ) on which the main screen exists is open at about 135° relative to the main body case 11 on which the auxiliary screen exists.

FIG. 9B shows a case in which the open angle θ of the lid case 12 relative to the main body case 11 is set to 180° so as to make the lid case 12 side, on which the main screen exists, flush with the main body case 11 on which the auxiliary screen exists.

The CPU 21 reads the gamma correction values δ and δ' from the gamma correction table storage unit 22B and executes gamma correction in display driving on the main screen 17*d* and the auxiliary screen 16*d* based on the read gamma correction values δ and δ', thereby adjusting the display tones of the two screens so as to reliably position the eye UE of the user within the viewing angle.

Assume that in the use of the electronic dictionary apparatus 10 while being held in the landscape position, gamma correction values are set and stored in the gamma correction table storage unit 22B assuming that the eye (the dominant eye, in particular) UE of the user is located at the front of the touchpanel color display unit (main screen) 17 as shown in FIGS. 9A and 9B.

The CPU 21 therefore executes display control by the above gamma correction so as to set a smaller viewing angle on the touchpanel color display unit (main screen) 17 on the lid case 12 side, while executing display control so as to set a wider viewing angle on the handwriting input unit (auxiliary screen) 16 on the main body case 11 side.

As described above in detail, according to this embodiment, it is possible to ensure optical visual fields on both the touchpanel color display unit (main screen) 17 on the lid case 12 side and the handwriting input unit (auxiliary screen) 16 on the main body case 11 side in either of the cases in which the user uses the electronic dictionary apparatus 10 in the stationary position, in the portrait position, and in the landscape position.

In addition, according to the above embodiment, as shown in FIGS. 6A, 6B, and 6C, the tables store gamma correction values for display control on the two screens in correspondence with the respective cases in which the user uses the electronic dictionary apparatus 10 in the stationary position, in the portrait position, and in the landscape position, while the range of the open angles θ which the lid case 12 on which the main screen 17 is provided can take with respect to the main body case 11 on which the auxiliary screen exists is limited to, for example, 90 to 180°.

Storing only necessary gamma correction values in the tables in this manner in consideration of assumed usages makes it possible to decrease the capacity of the tables required for control and reduce the circuit size and the load on control programs.

Second Embodiment

The second embodiment in which the present invention is applied to an electronic dictionary apparatus will be described below with reference to the views of the accompanying drawing.

The outer arrangement of an electronic dictionary apparatus 10' according to this embodiment is basically the same as that shown in FIG. 1, and the arrangements of electronic circuits provided in a main body case 11 and lid case 12 of the electronic dictionary apparatus 10' are basically the same as those shown in FIG. 3. Therefore, the same reference numerals denote the same parts, and an illustration and description of them will be omitted.

The operation of the above embodiment will be described next.

In this embodiment, the user basically uses the electronic dictionary apparatus 10' in either of the following forms: using the apparatus while holding it in the portrait position with the main body case 11 and the lid case 12 being wide open as shown in FIG. 4A; and using the apparatus while holding it in the landscape position with the main body case 11 and the lid case 12 being wide open as shown in FIG. 4B.

The operation of the electronic dictionary apparatus 10' in a case in which the user uses the apparatus while holding it in the portrait position or landscape position will be described below.

Figure 10:
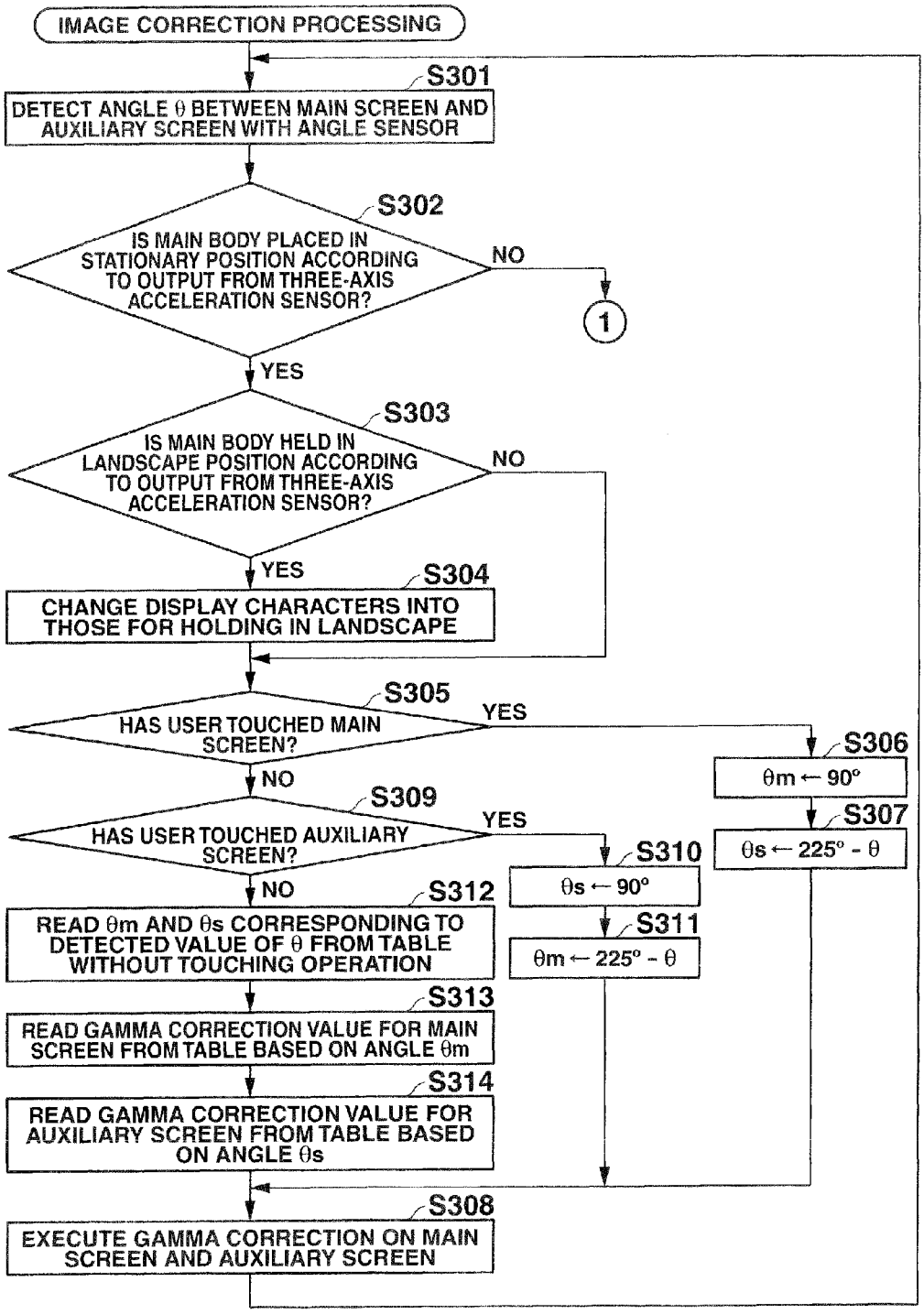
FIG. 10 is a flowchart showing the contents of display correction processing to be performed in accordance with the angles of both the main and auxiliary screens according to the second embodiment of the present invention.

FIG. 10 is a flowchart showing processing associated with display control on a color liquid crystal display screen 17*d* as a main screen and a color liquid crystal display screen 16*d* as an auxiliary screen, which is performed by a CPU 21 in the electronic dictionary apparatus 10'.

First of all, the CPU 21 detects an open angle between the lid case 12 having a main screen and the main body case 11 having an auxiliary screen based on an output from an angle sensor 41 (step S301).

The CPU 21 then determines whether the main body case 11 of the electronic dictionary apparatus 10' is placed on a horizontal place on, for example, a desk, by determining whether a detection output from a three-axis acceleration sensor 28 provided on the main body case 11 side in the Z-axis direction is almost equal to the gravitational acceleration component, and its displacement angle is almost zero (step S302).

In this case, upon determining that the detection output from the three-axis acceleration sensor 28 in the Z-axis direction is almost equal to the gravitational acceleration component and the main body case 11 of the electronic dictionary apparatus 10' is placed on a flat place, the CPU 21 performs processing similar to that in step S103 and the subsequent steps in FIG. 5 described above. A detailed description of the subsequent processing will be omitted in this embodiment.

Upon determining in step S302 that the main body case 11 is not placed on a horizontal place, the CPU 21 determines whether the main body case 11 of the electronic dictionary apparatus 10' is held in the landscape position shown in FIG. 4B, by determining whether the detection output from the three-axis acceleration sensor 28 provided on the main body case 11 side in the X-axis direction is almost equal to the gravitational acceleration component and its displacement angle is almost zero (step S303).

In this case, the CPU 21 determines that the electronic dictionary apparatus 10' is held in the landscape position, only when the detection output from the three-axis acceleration sensor 28 in the X-axis direction is almost equal to the gravitational acceleration component and its displacement angle is almost zero, and changes/sets characters to be displayed to those for "holding in landscape" on both the color liquid crystal display screen 17*d* as a main screen and the color liquid crystal display screen 16*d* as an auxiliary screen (step S304).

The CPU 21 does not perform the processing in step S304 if the CPU 21 determines that the electronic dictionary apparatus 10' is not held in the landscape position.

Subsequently, the CPU 21 determines, based on the presence/absence of an output from a transparent touchpanel 17*t* of a touchpanel color display unit (main screen) 17, whether the user has touched the main screen (step S305).

Upon determining that the user has touched the screen, the CPU 21 determines that an eye UE of the user is located at the front of the touchpanel color display unit (main screen) 17, and sets an interior angle θm defined by the main screen and the eye UE of the user to 90° (step S306).

The CPU 21 then calculates and sets an interior angle θs defined by the auxiliary screen and the eye UE of the user according to (225°−θ) by using the value of an open angle θ between the main body case 11 and the lid case 12 obtained in immediately preceding step S301 (step S307).

Subsequently, the CPU 21 refers to a gamma correction table storage unit 22B with the angle θm on the main screen side and the angle θs on the auxiliary screen side, which are obtained above, reads corresponding gamma correction values αm and αs, and executes gamma correction in display driving on the color liquid crystal display screen 17*d* and the color liquid crystal display screen 16*d* (step S308). The process then returns to processing starting from step S301 described above.

FIG. 11A exemplifies a table of gamma correction values associated with the interior angles θm indicating the positions/directions of the eye UE of the user relative to the main screen and is stored in the gamma correction table storage unit 22B of a program memory 22. As shown in FIG. 11A, this table stores gamma correction values αm in increments of 1° as the angle θm defined by the main screen and the eye UE of the user changes from 0° to 150°.

FIG. 11B exemplifies a table of gamma correction values associated with the interior angles θs indicating the positions/directions of the eye UE of the user relative to the auxiliary screen and is stored in the gamma correction table storage unit 22B of the program memory 22. As shown in FIG. 11B, this table stores gamma correction values as in increments of 1° as the angle θs defined by the auxiliary screen and the eye UE of the user changes from 0° to 150°.

Figure 12A:
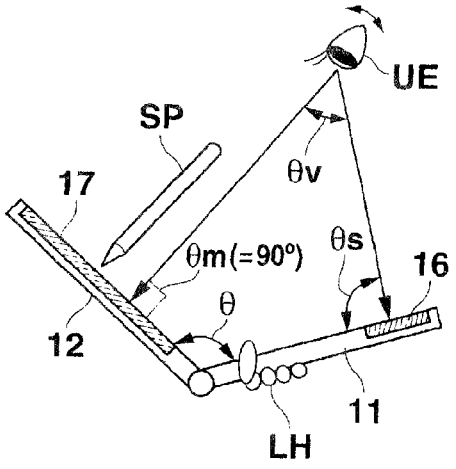
FIG. 12A is a view showing the positional relationship between the eye of the user and each screen at the time of use of an electronic dictionary apparatus according to the second embodiment held in the portrait position.
Figure 12B:
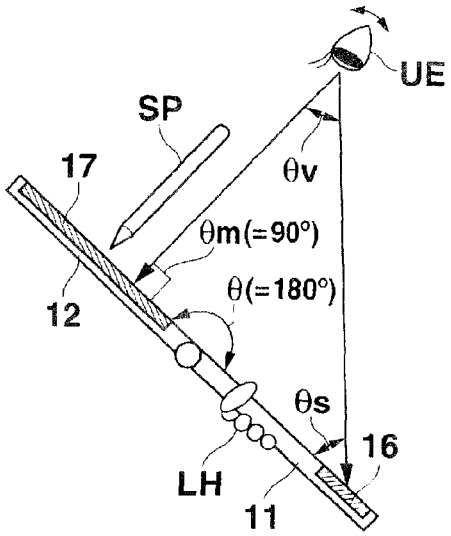
FIG. 12B is a view showing the positional relationship between the eye of the user and each screen at the time of use of the electronic dictionary apparatus held in the portrait position.

FIGS. 12A and 12B are views each showing a case in which the positional relationship between the eye UE of the user and each screen is viewed laterally when the user uses the electronic dictionary apparatus 10' while holding it in the portrait position and touches the transparent touchpanel 17*t* on the main screen side. Assume that in FIGS. 12A and 12B, the user touches the transparent touchpanel 17*t* with a stylus pen SP, and the angle of each screen is estimated, assuming that the distance between the main screen 17 and the eye UE of the user is a distance specified in advance, for example, about 40 cm.

FIG. 12A shows a state in which the lid case 12 on which the main screen exists is open at an angle of about 135° relative to the main body case 11 on which the auxiliary screen exists. Letting θv be a line-of-sight angle which moves when the eye UE of the user sees the main screen 17 and an auxiliary screen 16, the following equation holds:

$$\theta+\theta m+\theta s+\theta v=360^\circ \text{ (the sum of the interior angles of a rectangle)}$$

If, therefore, for example, θm=90° and θv=45', θs=225°−θ. It is possible to uniquely derive an interior angle θs defined between the eye UE of the user and the auxiliary screen 16 from a detection output from the angle sensor 41.

FIG. 12B shows a case in which the open angle θ of the lid case 12 relative to the main body case 11 is set to 180° so as to make the lid case 12 side, on which the main screen exists, flush with the main body case 11 on which the auxiliary screen exists.

In either of the cases shown in FIGS. 12A and 12B, the CPU 21 estimates the interior angle θs between the auxiliary screen and the line of sight of the eye UE of the user, assuming from touching operation on the transparent touchpanel 17*t* on the main screen side that the eye UE of the user is located at the front of the main screen and the interior angle between the main screen and the eye UE of the user is 90° and that the distance between the main screen 17 and the eye UE of the user is specified as described above.

Figure 14A:
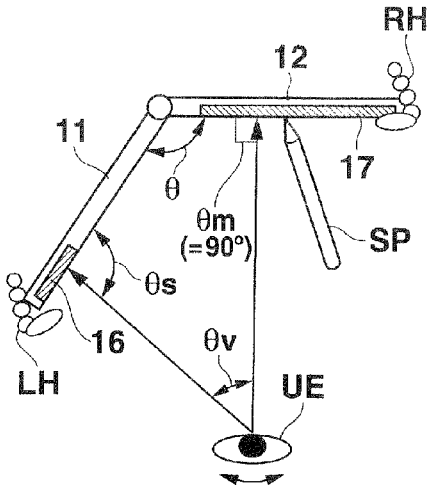
FIG. 14A is a view showing the positional relationship between the eye of the user and each screen at the time of use of the electronic dictionary apparatus according to the second embodiment held in the landscape position.
Figure 14B:
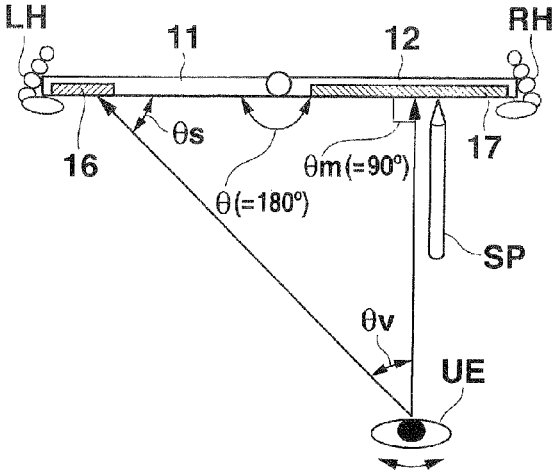
FIG. 14B is a view showing the positional relationship between the eye of the user and each screen at the time of use of the electronic dictionary apparatus according to the second embodiment held in the landscape position.

FIGS. 14A and 14B are views each showing a case in which the positional relationship between the eye UE of the user and each screen is viewed from above when the user uses the electronic dictionary apparatus 10' while holding it in the landscape position and touches the transparent touchpanel 17*t* on the main screen side. Assume that in FIGS. 14A and 14B, the user touches the transparent touchpanel 17*t* with the stylus pen SP, and the angle of each screen is estimated, assuming that the distance between the main screen 17 and the eye UE of the user is a distance specified in advance, for example, about 40 cm.

FIG. 14A shows a state in which the lid case 12 on which the main screen exists is open at an angle of about 13.5° relative to the main body case 11 on which the auxiliary screen exists.

FIG. 14B shows a case in which the open angle θ of the lid case 12 relative to the main body case 11 is set to 180° so as to make the lid case 12 side, on which the main screen exists, flush with the main body case 11 on which the auxiliary screen exists.

In either of the cases shown in FIGS. 14A and 14B, the CPU 21 estimates the interior angle θs between the auxiliary screen and the eye UE of the user, assuming from touching operation on the transparent touchpanel 17*t* on the main screen side that the eye UE of the user is located at the front of the main screen and the interior angle between the main screen and the eye UE of the user is 90° and that the distance between the main screen 17 and the eye UE of the user is specified as described above.

The CPU 21 reads gamma correction values αm and αs from the gamma correction table storage unit 22B described above and executes gamma correction in display driving on the main screen 17*d* and the auxiliary screen 16*d* based on the read gamma correction values αm and αs, thereby adjusting the display tones of the two screens so as to reliably position the eye UE of the user within the viewing angle.

Upon determining in step S305 that the user has not touched the main screen, the CPU 21 determines, based on the presence/absence of an output from the transparent touchpanel 16*t* of the handwriting input unit (auxiliary screen) 16, whether the user has touched the auxiliary screen (step S309).

Upon determining that the user has touched the auxiliary screen, the CPU 21 sets the interior angle θs defined between the auxiliary screen and the eye UE of the user to 90°, assuming that the eye UE of the user is located at the front of the handwriting input unit (auxiliary screen) 16 (step S310).

The CPU 21 then calculates and sets the interior angle θm between the main screen and the eye UE of the user according to (225°−θ) by using the value of the open angle θ between the main body case 11 and the lid case 12, which is obtained in immediately preceding step S301 (step S311).

The CPU 21 then refers to the gamma correction table storage unit 22B with the angle θm on the main screen side and the angle θs on the auxiliary screen side, which are obtained above, reads corresponding gamma correction values αm and αs, and executes gamma correction in display driving on the color liquid crystal display screen 17*d* and the color liquid crystal display screen 16*d* (step S308). The process then returns to processing starting from step S301 described above.

Figure 13A:
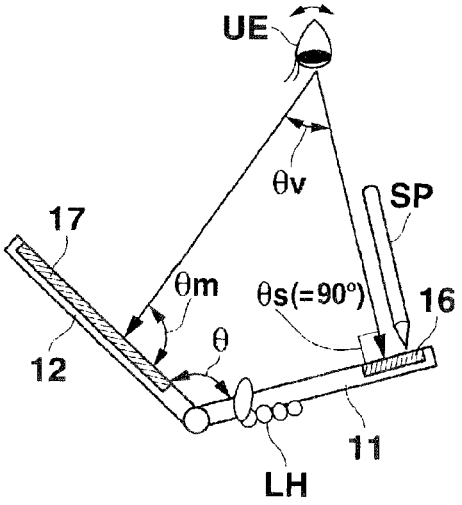
FIG. 13A is a view showing the positional relationship between the eye of the user and each screen at the time of use of an electronic dictionary apparatus according to the second embodiment held in the portrait position.
Figure 13B:
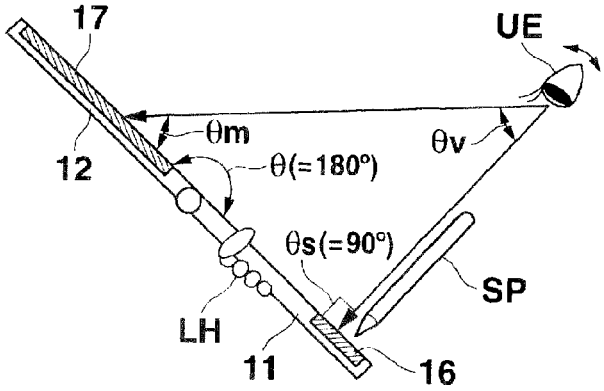
FIG. 13B is a view showing the positional relationship between the eye of the user and each screen at the time of use of the electronic dictionary apparatus according to the second embodiment held in the portrait position.

FIGS. 13A and 13B are views each showing a case in which the positional relationship between the eye UE of the user and each screen is viewed laterally when the user uses the electronic dictionary apparatus 10' while holding it in the portrait position and touches the transparent touchpanel 16*t* on the auxiliary screen side. Assume that in FIGS. 13A and 13B, the user touches the transparent touchpanel 16*t* with the stylus pen SP, and the angle of each screen is estimated, assuming that the distance between the auxiliary screen 16 and the eye UE of the user is a distance specified in advance, for example, about 40 cm.

FIG. 13A shows a state in which the lid case 12 on which the main screen exists is open at an angle of about 135° relative to the main body case 11 on which the auxiliary screen exists.

FIG. 13B shows a case in which the open angle θ of the lid case 12 relative to the main body case 11 is set to 180° so as to make the lid case 12 side, on which the main screen exists, flush with the main body case 11 on which the auxiliary screen exists.

In either of the cases shown in FIGS. 13A and 13B, the CPU 21 estimates the interior angle θm between the main screen and the eye UE of the user, assuming from touching operation on the transparent touchpanel 16*t* on the auxiliary screen side that the eye UE, of the user is located at the front of the auxiliary screen and the interior angle between the main screen and the eye UE of the user is 90° and that the distance between the auxiliary screen 16 and the eye UE of the user is specified as described above.

Figure 15A:
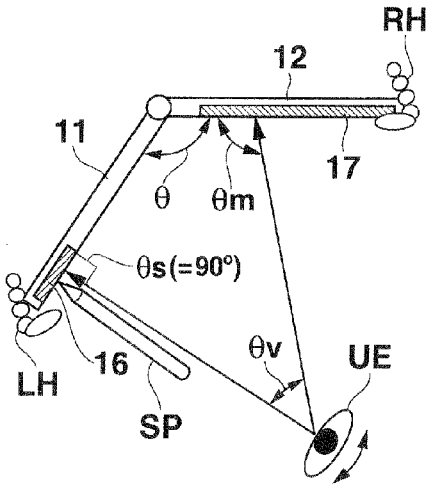
FIG. 15A is a view showing the positional relationship between the eye of the user and each screen at the time of use of the electronic dictionary apparatus according to the second embodiment held in the landscape position.
Figure 15B:
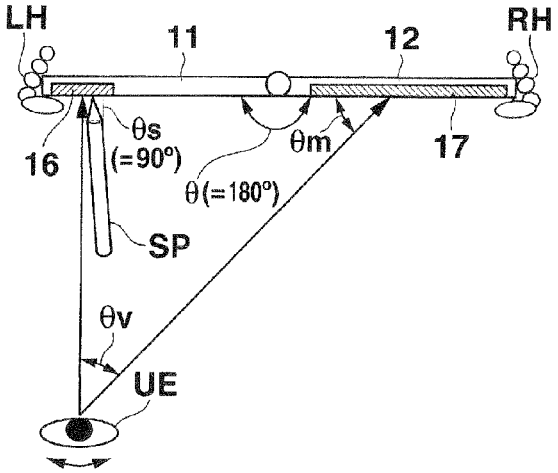
FIG. 15B is a view showing the positional relationship between the eye of the user and each screen at the time of use of the electronic dictionary apparatus according to the second embodiment held in the landscape position.

FIGS. 15A and 15B are views each showing a case in which the positional relationship between the eye UE of the user and each screen is viewed from above when the user uses the electronic dictionary apparatus 10' while holding it in the landscape position and touches the transparent touchpanel 16*t* on the auxiliary screen side. Assume that in FIGS. 15A and 15B, the user touches the transparent touchpanel 16*t* with the stylus pen SP, and the angle of each screen is estimated, assuming that the distance between the auxiliary screen 16 and the eye UE of the user is a distance specified in advance, for example, about 40 cm.

FIG. 15A shows a state in which the lid case 12 on which the main screen exists is open at an angle of about 135° relative to the main body case 11 on which the auxiliary screen exists.

FIG. 15B shows a case in which the open angle θ of the lid case 12 relative to the main body case 11 is set to 180° so as to make the lid case 12 side, on which the main screen exists, flush with the main body case 11 on which the auxiliary screen exists.

In either of the cases shown in FIGS. 15A and 15B, the CPU 21 estimates the interior angle θm between the main screen and the eye UE of the user, assuming from touching operation on the transparent touchpanel 16*t* on the auxiliary screen side that the eye UE of the user is located at the front of the auxiliary screen and the interior angle between the auxiliary screen and the eye UE of the user is 90° and that the distance between the auxiliary screen 16 and the eye UE of the user is specified as described above.

The CPU 21 reads gamma correction values αm and αs from the gamma correction table storage unit 22B described above and executes gamma correction in display driving on the main screen 17*d* and the auxiliary screen 16*d* based on the read gamma correction values αm and αs, thereby adjusting the display tones of the two screens so as to reliably position the eye UE of the user within the viewing angle.

Upon determining in step S309 that the user has not touched the auxiliary screen, the CPU 21 determines that the user has touched neither the main screen 17 nor the auxiliary screen 16, and reads θm and θs corresponding to the value of the open angle θ of the hinge portion 13 detected in immediately preceding step S301 from the gamma correction table storage unit 22B of the program memory 22 (step S312).

FIG. 11C exemplifies a table indicating the estimated values of the line-of-sight angle θm on the main screen and the line-of-sight angle θs on the auxiliary screen which correspond to the open angle θ without touching operation, which are stored in the gamma correction table storage unit 22B in advance. This table stores θm and θs in increments of 1° as the open angle θ changes from 90 to 180° when the user uses the electronic dictionary apparatus 10' while holding it in the portrait position or the landscape position and mainly sees the touchpanel color display unit (main screen) 17 on the lid case 12 side, with the distance between the eye UE of the user and the main screen being held at a typical distance, for example, 30 cm.

Upon reading the estimated values of θm and θs corresponding to the open angle θ without touching operation from the gamma correction table storage unit 22B, the CPU 21 reads first the gamma correction value αm for the main screen from the table shown in FIG. 11A in the gamma correction table storage unit 22B according to the estimated value of the interior angle θm between the main screen 17 and the line of sight of the user (step S313).

The CPU 21 then reads the gamma correction value αs for the auxiliary screen from the table shown in FIG. 11B in the gamma correction table storage unit 22B according to the estimated value of the interior angle θs between the auxiliary screen 16 and the line of sight of the user in the same manner (step S314).

The CPU 21 executes gamma correction in display driving on the color liquid crystal display screen 17*d* and the color liquid crystal display screen 16*d* by using the obtained gamma correction values αm and αs (step 308). The process then returns to the processing starting from step S301.

As has been described above in detail, both the touchpanel color display unit (main screen) 17 and the handwriting input unit (auxiliary screen) 16 include the transparent touchpanels 17*t* and 16*t* which allow the user to perform input operation by touching operation, and this apparatus is configured to perform gamma correction on the respective display units, assuming that when touching operation on one of the panels is detected, the eye UE of the user is located at the front of the panel. This makes it possible to execute accurate gamma correction in consideration of operability in actual operation and ensure optimal visual field for the user.

The above embodiments have exemplified the touchpanel color display unit (main screen) 17 and the handwriting input unit (auxiliary screen) 16, both of which are configured to allow to input operation by touching operation. However, the present invention is not limited to this. As long as at least one of a plurality of display units includes a transparent touchpanel, it is possible to implement display in an optimal visual field for the user by performing the same control as that described above when the user performs touching operation on the touchpanel.

Furthermore, the present invention is not limited to each embodiment described above, and can be variously modified in the execution stage within the spirit and scope of the invention. In addition, the functions implemented in the above embodiments may be executed in proper combinations if possible. The above embodiments include inventions of various stages, and various inventions can be extracted by proper combinations of a plurality of disclosed constituent elements. Even if several constituent elements are omitted from all the constituent elements in each embodiment, the arrangement from which these constituent elements are omitted can be extracted as an invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An information display apparatus comprising:

a plurality of display units separately arranged in a foldable housing, wherein at least one of the plurality of display units includes a touchpanel which allows a user to perform a touch input operation;

a gamma storage unit which stores gamma correction values for each of the plurality of display units, wherein the gamma correction values for each of the plurality of display units are respectively associated with line-of-sight angles including a right angle, and wherein each line-of-sight angle is defined by a surface of the display unit and a line-of-sight of the user's eye;

a line-of-sight angle storage unit which stores estimated values of the line-of-sight angles for each of the plurality of display units in correspondence with open angles between the plurality of display units;

a detection unit which detects an open angle between the plurality of display units;

a display control unit which determines estimated values of the line-of-sight angles for each of the plurality of display units by referring to the line-of-sight angle storage unit, based on the open angle between the plurality of display units detected by the detection unit, and which performs gamma correction on each of the plurality of display units based on the determined estimated line-of-sight angles; and a first angle correction unit which, when the user performs the touch input operation on the one of the plurality of display units which includes the touchpanel, sets the estimated line-of-sight angle defined by a surface of the touched display unit and the line-of-sight of the user's eye to a right angle.

2. The information display apparatus of claim 1, further comprising a second angle correction unit which, when the user performs the touch input operation on the one of the plurality of display units which includes the touchpanel, corrects the estimated line-of-sight angle for another one of the plurality of display units other than the touched display unit.

3. The information display apparatus of claim 2, wherein the second angle correction unit corrects the estimated line-of-sight angle for said another one of the plurality of display units based on the open angle between the plurality of display units detected by the detection unit.

4. A display method for an apparatus including (i) a plurality of display units separately arranged in a foldable housing, wherein at least one of the plurality of display units includes a touchpanel which allows a user to perform a touch input operation, and (ii) a memory which stores (a) gamma correction values for each of the plurality of display units, wherein the gamma correction values for each of the plurality of display units are respectively associated with line-of-sight angles including a right angle, and wherein each line-of-sight angle is defined by a surface of the display unit and a line-of-sight of the user's eye, and (b) estimated values of the line-of-sight angles for each of the plurality of display units in correspondence with open angles between the plurality of display units, the method comprising:

detecting an open angle between the plurality of display units; and determining estimated values of the line-of-sight angles for each of the plurality of display units by referring to the stored estimated values of the line-of-sight angles, based on the detected open angle between the plurality of display units, and performing gamma correction on each of the plurality of display units based on the determined estimated line-of-sight angles, wherein when the user performs the touch input operation on the one of the plurality of display units which includes the touchpanel, the estimated line-of-sight angle defined by a surface of the touched display unit and the line-of-sight of the user's eye is set to a right angle.

5. The display method of claim 4, wherein when the user performs the touch input operation on the one of the plurality of display units which includes the touchpanel, the estimated line-of-sight angle for another one of the plurality of display units other than the touched display unit is corrected.

6. The display method of claim 5, wherein the estimated line-of-sight angle for said another one of the plurality of display units is corrected based on the detected open angle between the plurality of display units.

7. A non-transitory computer-readable storage medium having a program stored thereon for controlling a computer of an apparatus including (i) a plurality of display units separately arranged in a foldable housing, wherein at least one of the plurality of display units includes a touchpanel which allows a user to perform a touch input operation, and (ii) a memory which stores (a) gamma correction values for each of the plurality of display units, wherein the gamma correction values for each of the plurality of display units are respectively associated with line-of-sight angles including a right angle, and wherein each line-of-sight angle is defined by a surface of the display unit and a line-of-sight of the user's eye, and (b) estimated values of the line-of-sight angles for each of the plurality of display units in correspondence with open angles between the plurality of display units, the program controlling the computer to perform functions comprising:

detecting an open angle between the plurality of display units; and determining estimated values of the line-of-sight angles for each of the plurality of display units by referring to the stored estimated values of the line-of-sight angles, based on the detected open angle between the plurality of display units, and performing gamma correction on each of the plurality of display units based on the determined estimated line-of-sight angles, wherein when the user performs the touch input operation on the one of the plurality of display units which includes the touchpanel, the estimated line-of-sight angle defined by a surface of the touched display unit and the line-of-sight of the user's eye is set to a right angle.

8. The non-transitory computer-readable storage medium of claim 7, wherein when the user performs the touch input operation on the one of the plurality of display units which includes the touchpanel, the estimated line-of-sight angle for another one of the plurality of display units other than the touched display unit is corrected.

9. The non-transitory computer-readable storage medium of claim 8, wherein the estimated line-of-sight angle for said another one of the plurality of display units is corrected based on the detected open angle between the plurality of display units.

* * * * *